US007895749B2

(12) United States Patent
Eto et al.

(10) Patent No.: US 7,895,749 B2
(45) Date of Patent: Mar. 1, 2011

(54) METHOD OF MANUFACTURING HEAT EXCHANGER

(75) Inventors: Yoshihisa Eto, Konan (JP); Naoto Takayanagi, Konan (JP); Shoji Akiyama, Konan (JP); Muneo Sakurada, Konan (JP)

(73) Assignee: Valeo Thermal Systems Japan Corporation, Saitama (JP)

( * ) Notice: Subject to any disclaimer, the term of this patent is extended or adjusted under 35 U.S.C. 154(b) by 57 days.

(21) Appl. No.: 12/382,962

(22) Filed: Mar. 27, 2009

(65) Prior Publication Data

US 2009/0188111 A1 Jul. 30, 2009

Related U.S. Application Data

(62) Division of application No. 10/546,069, filed as application No. PCT/JP2004/001699 on Feb. 17, 2004, now abandoned.

(30) Foreign Application Priority Data

Feb. 19, 2003 (JP) ..... 2003-040752

(51) Int. Cl.
*B23P 15/26* (2006.01)

(52) U.S. Cl. ..... 29/890.053

(58) Field of Classification Search ..... 29/890.053, 29/890.03, 890.038, 890.04, 890.045, 890.046, 29/458, 460, 527.1, 527.2; 165/173, 174, 165/176, 110, 133, 183, 177
See application file for complete search history.

(56) References Cited

U.S. PATENT DOCUMENTS

| | | | | |
|---|---|---|---|---|
| 2,063,757 | A | 12/1936 | Saunders | |
| 3,053,511 | A | 9/1962 | Godfrey | |
| 3,521,707 | A | 7/1970 | Brown | |
| 5,924,485 | A * | 7/1999 | Kobayashi et al. | 165/173 |
| 7,107,680 | B2 | 9/2006 | Ueda | |
| 7,117,936 | B2 | 10/2006 | Ohata et al. | |

FOREIGN PATENT DOCUMENTS

| | | |
|---|---|---|
| JP | 11-216592 | 8/1999 |
| JP | 2000-329488 | 11/2000 |
| JP | 2002-011570 | 1/2002 |
| JP | 2003-019555 | 1/2003 |

OTHER PUBLICATIONS

International Search Report issued Jun. 1, 2004 in the International (PCT) Application PCT/JP2004/001699 of which the present application is the U.S. National Stage.

* cited by examiner

*Primary Examiner* — John C Hong
(74) *Attorney, Agent, or Firm* — Wenderoth, Lind & Ponack, L.L.P.

(57) ABSTRACT

A heat exchange tube is formed by using a sheet member not clad with a brazing material layer, with bonding regions at which ends of the sheet member are overlapped and brazed by using a brazing material. This structure reduces the extent to which the brazing material becomes dispersed while the heat exchange tube is brazed and the likelihood of dissolution due to erosion, which makes it possible to assure the desired product quality, such as corrosion resistance, even when a tube material with a smaller wall thickness is used.

5 Claims, 7 Drawing Sheets

(a)

(b)

METHOD OF MANUFACTURING HEAT EXCHANGER

CROSS-REFERENCE TO RELATED APPLICATIONS

This application is a divisional of application Ser. No. 10/546,069 filed on May 1, 2006, now abandoned which is the U.S. National Phase Application, under 35 USC 371 of International Application PCT/JP2004/001699, filed on Feb. 17, 2004, published as WO 2004/074757 A1 on Sep. 2, 2004, and claiming priority to JP 2003-040752, filed Feb. 19, 2003, the disclosures of all of which are incorporated herein by reference.

BACKGROUND OF THE INVENTION

1. Technical Field

The present invention relates to a structure that may be adopted in heat exchange tubes in a heat exchanger having a tank formed through extrusion molding and tubes formed through roll forming, which are bonded through a brazing process in a furnace.

2. Background Art

Today, heat exchange tubes in a heat exchanger having tanks and heat exchange tubes formed independently of each other are often manufactured through roll forming by bending a thin rolled sheet material so as to reduce the number of dies used in the manufacturing process for cost reduction. In the roll forming process, a sheet member needs to be bonded with a high level of airtightness at the bonding regions. This requirement is addressed in a method (see, for instance, Japanese Unexamined Patent Publication No. H11-216592) in which a brazing material layer is formed so as to cover a surface of the sheet member on one side and the sheet member is brazed at the bonding regions by using the brazing material layer.

However, if the heat exchange tubes themselves are coated with a brazing material layer, as in the Japanese Unexamined Patent Publication mentioned above, problems such as the dispersion of the brazing material during the brazing process and erosion make it difficult to reduce the wall thickness of the material, and thus, the heat exchanger cannot be provided as a compact, lightweight and inexpensive unit.

Accordingly, an object of the present invention is to provide a heat exchanger achieving a smaller wall thickness for the heat exchange tubes and a reduction in the manufacturing costs by supplying brazing material from the tank side to be used to braise the heat exchange tubes at their bonding regions without covering the heat exchange tubes themselves with a brazing material layer.

BRIEF SUMMARY OF THE INVENTION

The present invention provides a heat exchanger having heat exchange tubes formed by rolling sheet material and a pair of tanks to which ends of the heat exchange tubes on the two sides along the lengthwise direction inserted therein are bonded, and characterized in that the heat exchange tubes are constituted with sheet material not clad with a brazing material layer and that bonding regions at which the sheet material overlaps are brazed by using a brazing material. The heat exchange tubes may be constituted of a sheet member not clad with a brazing material layer, which includes a sacrificial corrosion layer applied onto the outer side of a core material. In addition, the bonding regions at which the sheet material overlaps are brazed by providing a brazing material that has been supplied to tube insertion hole formation surfaces of the tanks and further to the bonding regions through capillary action.

Since the heat exchange tubes are not clad with a brazing material layer, the dispersion of the brazing material during the brazing process and the erosion become non-issues, and thus, the wall thickness of the heat exchange tubes can be reduced. Consequently, a heat exchanger that includes such heat exchange tubes can be provided as a compact and lightweight unit at low cost.

In addition, the heat exchanger is characterized in that the heat exchange tubes are stacked so as to alternate with outer fins and that the outer fins and the edges of the contact surfaces of the tube bonding regions are not in contact with each other.

This structure ensures that when the heat exchanger is brazed in the furnace, the brazing material supplied into the spaces between the contact surfaces on the tube bonding region side from the tank surfaces through capillary action is not drawn toward the outer fin inside to cause a brazing defect at the tube bonding regions since the outer fins are not in contact with the contact surface edges.

The present invention is further characterized in that the tanks are formed through extrusion molding, that the brazing material is supplied to the tube insertion hole formation surfaces of the tanks by attaching brazing sheets to, at least, side surfaces of the tanks where they are conjoined with the tubes. Alternatively, the brazing material may be supplied to the side surfaces of the tanks formed through extrusion molding, at which they are conjoined with the tubes, by spraying the brazing material at least onto the tube insertion hole formation surfaces.

Since either of these measures eliminates the risk of the heat exchanging medium bypassing tank chambers due to defective brazing at a partitioning wall, the brazing material can be reliably supplied from the tank side even when the tanks are formed through extrusion molding to form the side and the partitioning portion of the tank as an integrated unit.

DETAILED DESCRIPTION OF THE INVENTION

The following is an explanation of an embodiment of the present invention, given in reference to the drawings.

Figure 1:
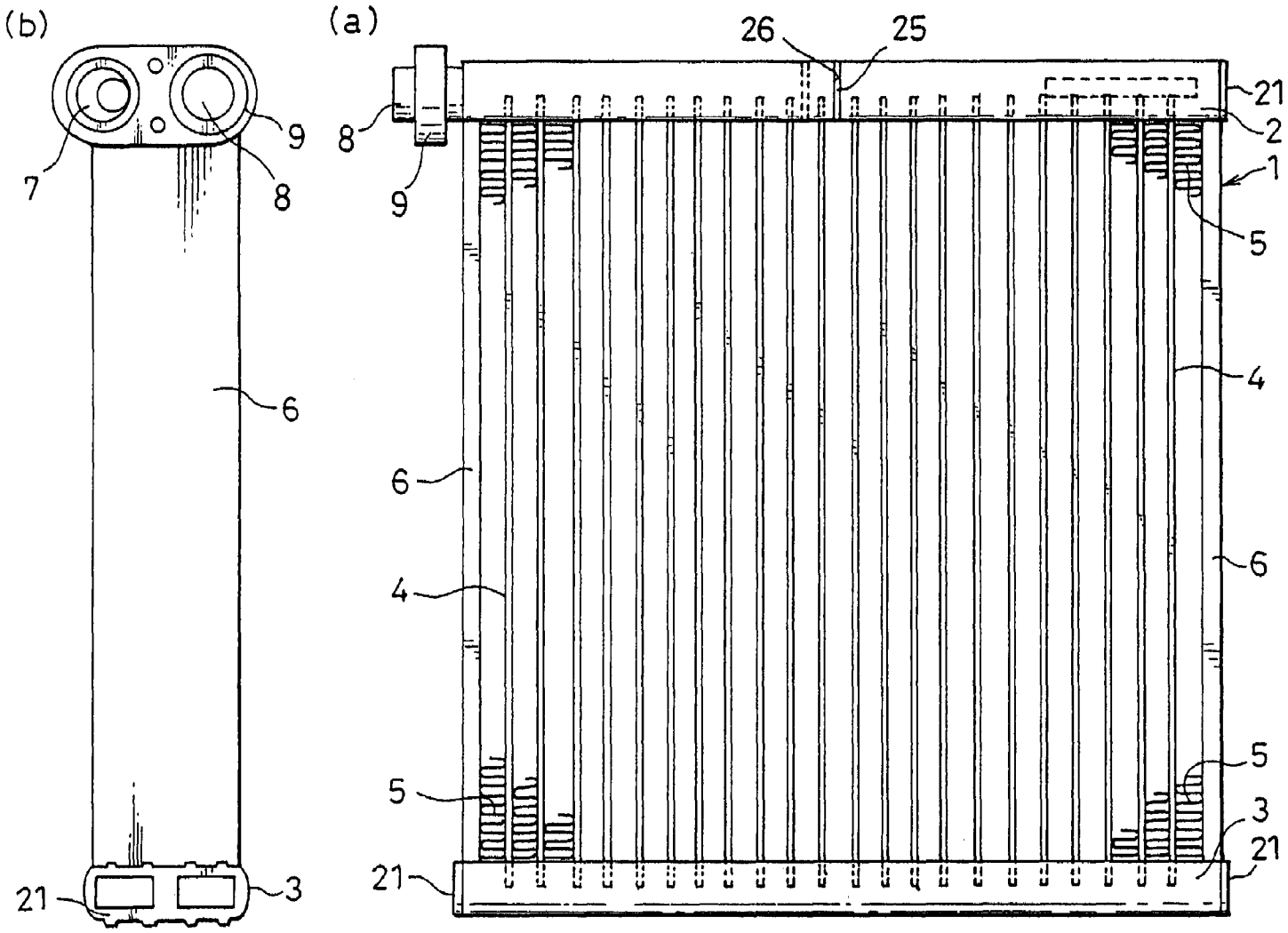
FIG. 1(*a*) is a rear view taken along the direction of airflow, showing the overall structure of a heat exchanger that includes the heat exchanger tanks according to the present invention and FIG. 1(*b*) is a side elevation of the overall structure of the heat exchanger in FIG. 1(*a*), viewed from the heat exchanging medium intake/outlet side.
Figure 2:
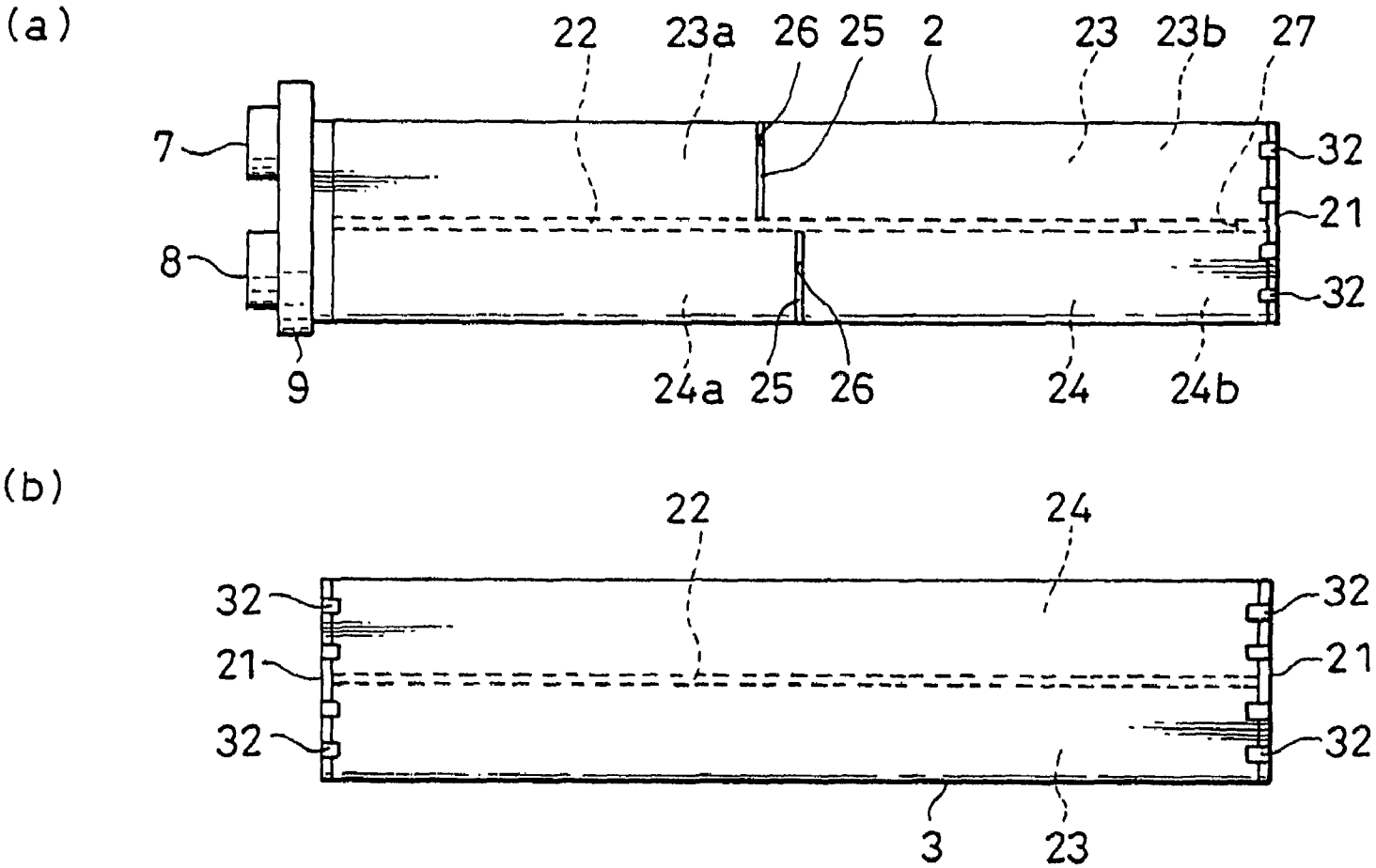
FIG. 2(*a*) illustrates the tank on the tube upper end side in the heat exchanger and FIG. 2(*b*) illustrates the tank on the tube lower end side in the heat exchanger.
Figure 3:
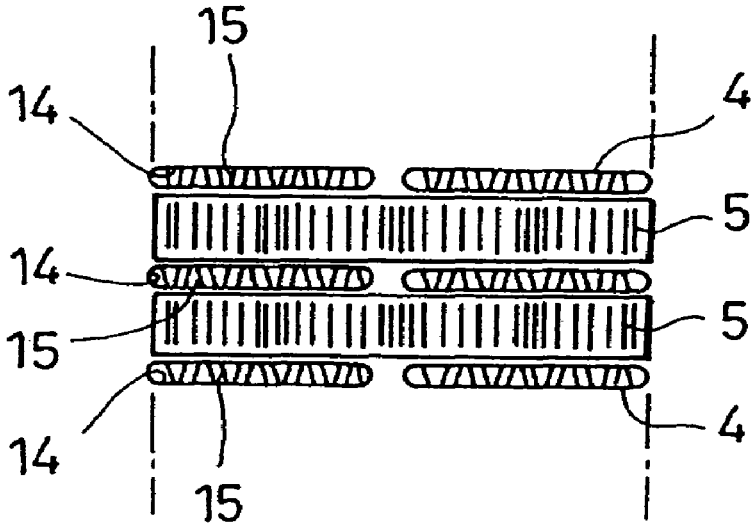
FIG. 3(*a*) illustrates the heat exchange tubes and the fins in the heat exchanger and FIG. 3(*b*) is a sectional view of a tank included in the heat exchanger.
Figure 3:
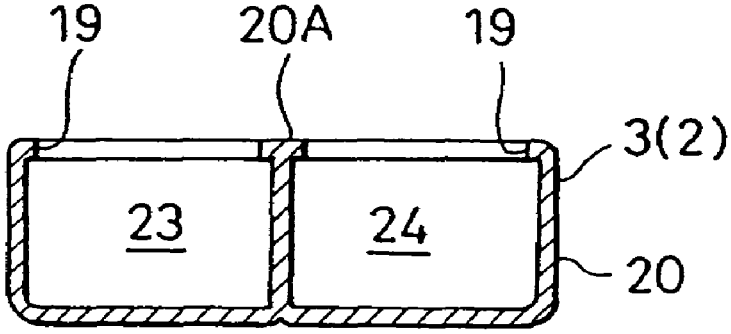

A heat exchanger 1 shown in FIGS. 1, 2 and 3 may be utilized as an evaporator constituting a refrigerating cycle in, for instance, an automotive air-conditioning system. The heat exchanger 1, which is assembled through furnace brazing, comprises a pair of tanks 2 and 3, a plurality of heat exchange tubes 4 communicating between the tanks 2 and 3, corrugated outer fins 5 stacked so as to alternate with the heat exchange tubes 4, side plates 6 disposed further outward relative to outer fins 5 set at the two ends along the stacking direction and a connector 9 disposed at one end of the tank 2 along the lengthwise direction. The connector 9 includes intake/outlet portions 7 and 8 through which a heat exchanging medium is taken in/let out, and is connected with an expansion valve (not shown).

In the heat exchanger 1, the heat exchanging medium fed from the expansion valve (not shown) flows into a chamber 23 at the tank 2 via the intake portion 7, the heat exchanging medium is then allowed to travel between the tanks 2 and 3 via the heat exchange tubes 4, heat exchange with the air passing between the outer fins 5 is induced as the heat exchanging medium travels between the tanks and finally the heat exchanging medium is let out from a chamber 24 at the tank 2 via the outlet portion 8.

As shown in FIGS. 3(*a*) and 4(*a*), the heat exchange tubes 4 are oblate tubes each having the two ends thereof along the lengthwise direction, which are inserted at the tanks 2 and 3, formed as open ends, a heat exchanging medium flow passage 14 formed therein and inner fins 15 housed therein. The heat exchange tubes 4 are formed by rolling a single thin sheet member constituted of metal with a high level of conductivity such as aluminum, and in the embodiment, the sheet member is folded in two lengthwise to form flat portions 4*a* and 4*b* facing opposite each other, a bend portion 4*c* at one end of its width and bonding regions 4*d* at the other end.

The inner fins 15 housed inside the heat exchange tube 4 include a connecting portion 15*a* formed along a side edge located on one side of the heat exchange tube 4, flat portions 15*b* and 15*c* connected via the connecting portion 15*a* and set in contact with the inner surfaces of the flat portions 4*a* and 4*b* of the heat exchange tube 4, and abutting portions 15*d* and 15*e* each projecting from an end of a flat portion 15*b* or 15*c* toward roughly the center of the opposite flat portion 15*c* or 15*b* with its apex set in contact with the inner surface of the opposite flat portion 15*b* or 15*c*. This structure makes it possible to increase the rigidity of each inner fin 15 along the widthwise direction, the level of the contact resistance against the force applied along the widthwise direction over the area where the inner fin 15 comes in contact with the heat exchange tube 4 and the level of rigidity against the restraining force imparted along the thickness-wise direction by the heat exchange tube 4. As a result, the inner fins 15 are not allowed to shift readily even when the heat exchange tube 4 already housing them is cut.

Figure 4:
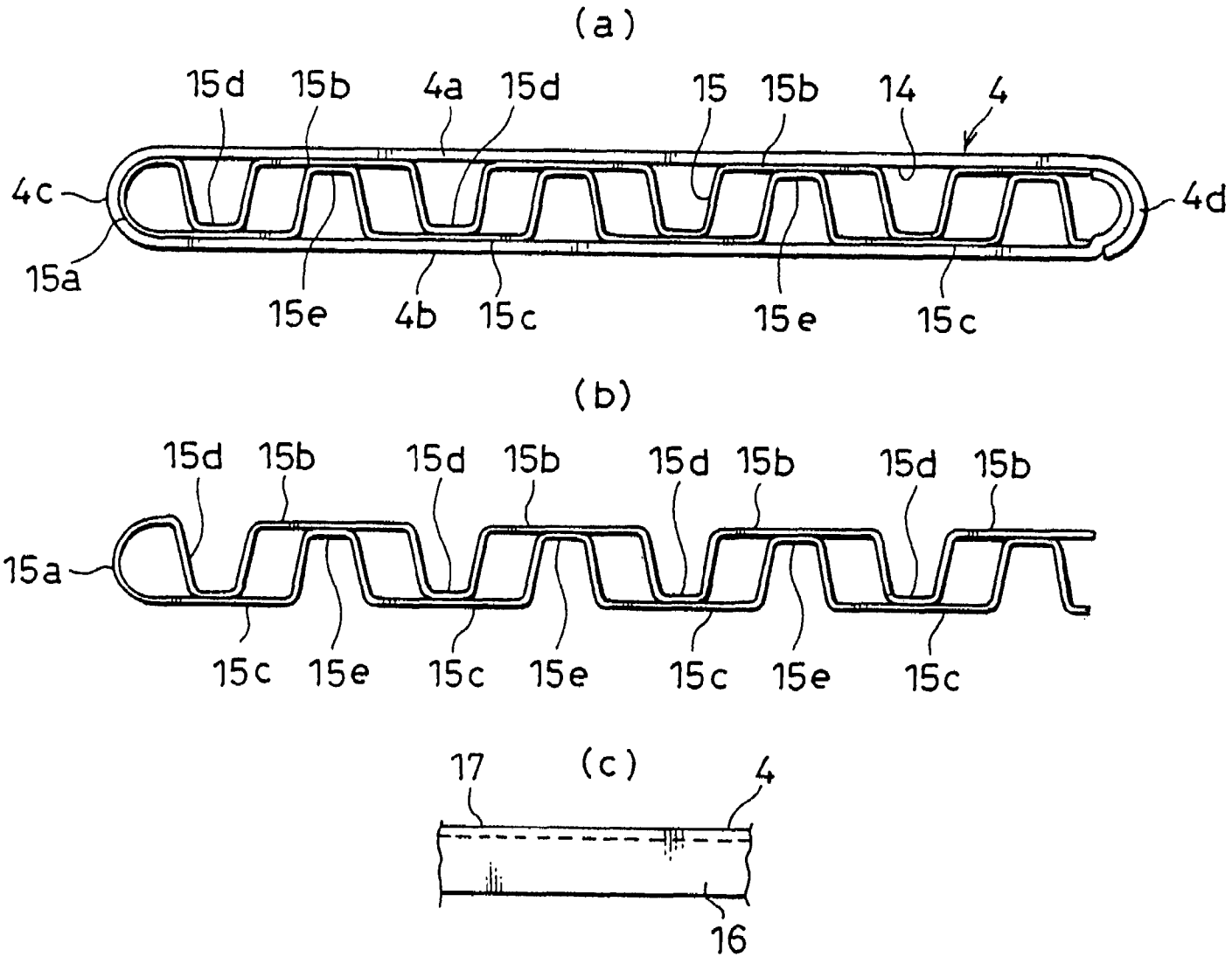
FIG. 4(*a*) shows the structure adopted in the heat exchange tubes, FIG. 4(*b*) shows the structure adopted in the inner fins enclosed in the heat exchange tubes and FIG. 4(*c*) shows in an enlargement the layers in a heat exchange tube.

The inner fins used in the embodiment are clad with a brazing material on both sides thereof, and the plate thickness of the inner fins 15 is set smaller than the wall thickness of the heat exchange tubes 4. In addition, as shown in FIG. 4(*c*), the heat exchanging tubes 4, not clad with a brazing material layer on their outer side, each include a sacrificial corrosion layer 17 on the outer side of a core material 16 located toward the tube. The sacrificial corrosion layer 17 may be formed prior to the roll forming process by first layering a material containing zinc or the like onto the core material 16 and then crimping the zinc-containing material or by spraying zinc or the like onto the core material 16. Such a heat exchange tube 4, unlike the heat exchange tube formed through extrusion molding, achieves superior corrosion resistance with the sacrificial corrosion layer 17 covering the front side surface thereof.

The tanks 2 and 3, which are disposed so as to face opposite each other over a predetermined distance, are formed through extrusion molding, as described above. Thus, their surfaces are not covered with a brazing material layer and they are constituted with an aluminum alloy in, for instance, the A3000 group.

To explain the tanks 2 and 3 in reference to FIGS. 3(*b*) and 5, the tanks 2 and 3 each include a tube insertion hole formation surface 20A where tube insertion holes 19 at which the heat exchange tubes 4 are inserted are formed. While each tank includes openings formed at the two ends along the length thereof, the openings except for the one located near the connector 9, are blocked off with caps 21, as shown in FIGS. 1 and 2. The tanks 2 and 3 each include a partitioning wall 22 formed as an integrated part of a side portion 20 so as to extend along the direction in which the heat exchange tubes 4 are stacked as shown in FIG. 5 and thus, the space inside each of the tanks 2 and 3 is divided into a chamber 23 and a chamber 24 set side-by-side along the direction of airflow.

The tanks 2 and 3 do not require a complicated structural feature in order to prevent the heat exchanging medium from bypassing the chambers 23 and 24 due to defective brazing of a member constituting the partitioning wall and a member constituting the side portion and thus, the tanks 2 and 3 are optimal components of the heat exchanger 1 that needs to be provided as a compact and inexpensive unit.

At the same time, the structures of the chambers 23 and 24 at the tank 2 differ from those at the tank 3, as shown in FIG. 2(*a*). Namely, the chambers 23 and 24 at the tank 2 are each partitioned along the direction of airflow by a partitioning plate 25 inserted through a slit 26 and thus, the chambers 23 and 24 are further divided into sub-chambers 23*a* and 23*b* and sub-chambers 24*a* and 24*b* respectively. In order to achieve a four-pass flow of the heat exchanging medium, the sub-chamber 23*b* and the sub-chamber 24*b* are made to communicate via a communicating passage 27. It is to be noted that the wall thickness of the partitioning wall 22 is set equal to or greater than 0.4 mm and equal to or smaller than 1.2 mm (normally 1 mm) to facilitate the process of punching the communicating passage 27 with a punch/die device (not shown) after the partitioning wall 22 is formed as an integrated part of the side portion 20 through extrusion molding, while assuring a sufficient level of strength for the partitioning wall.

Figure 5:
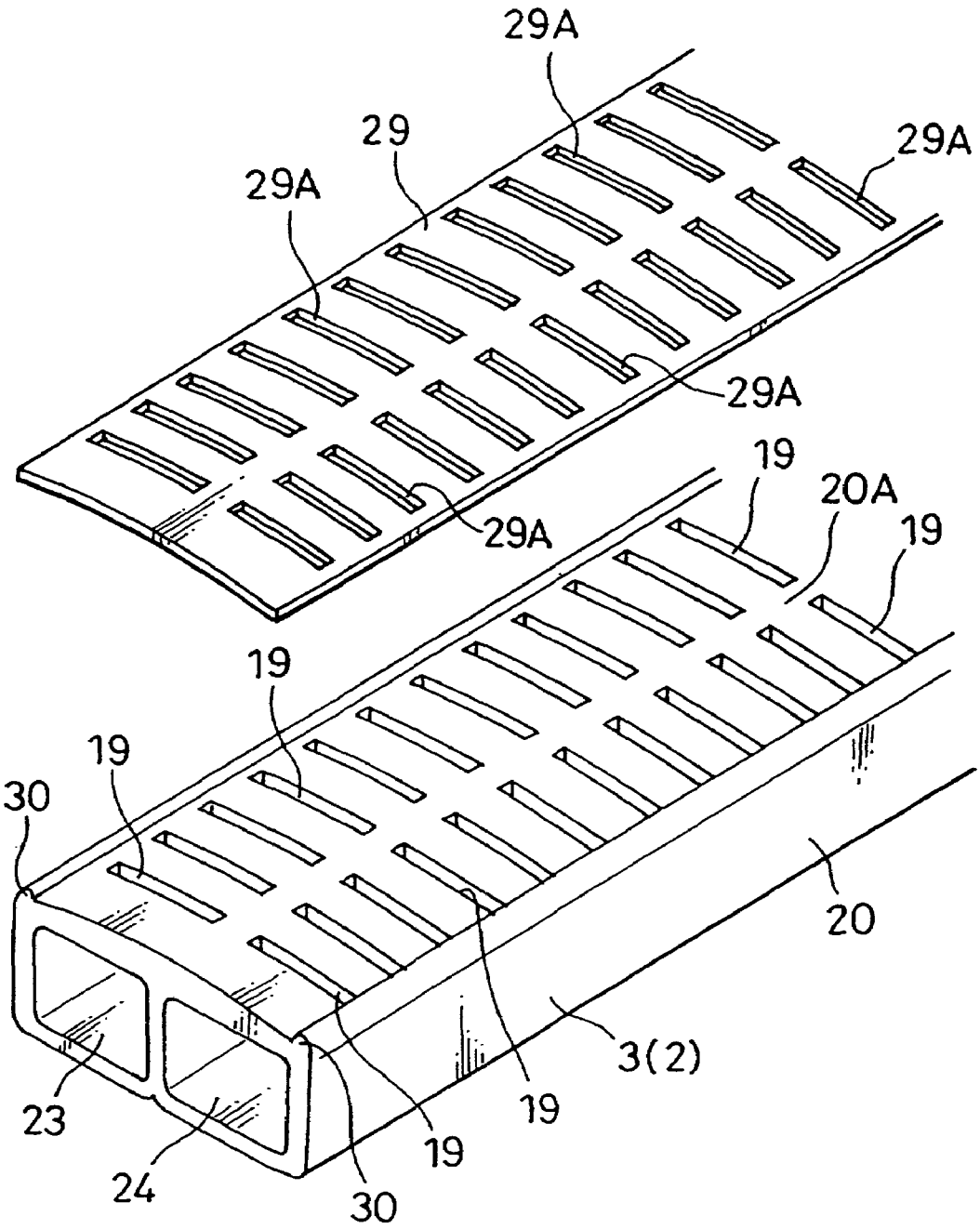
FIG. 5 illustrates a step during which a brazing material sheet is pasted onto a tank.
Figure 6:
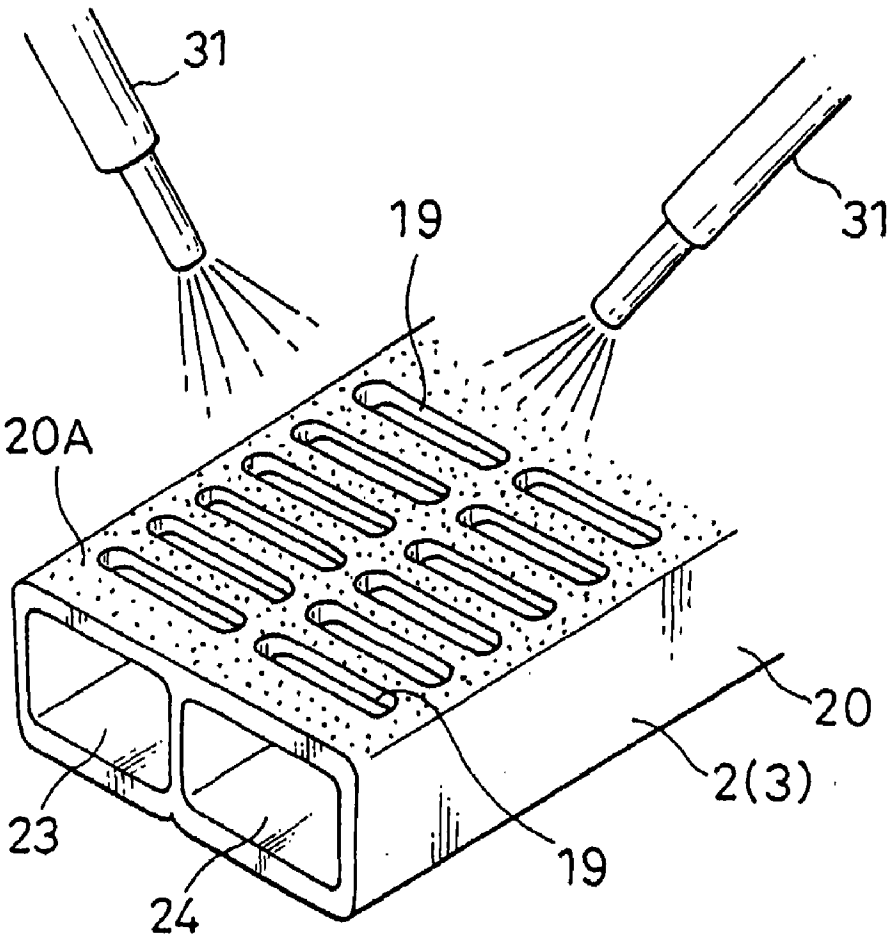
FIG. 6 illustrates a step in which a brazing material is sprayed onto a tank.
Figure 7:
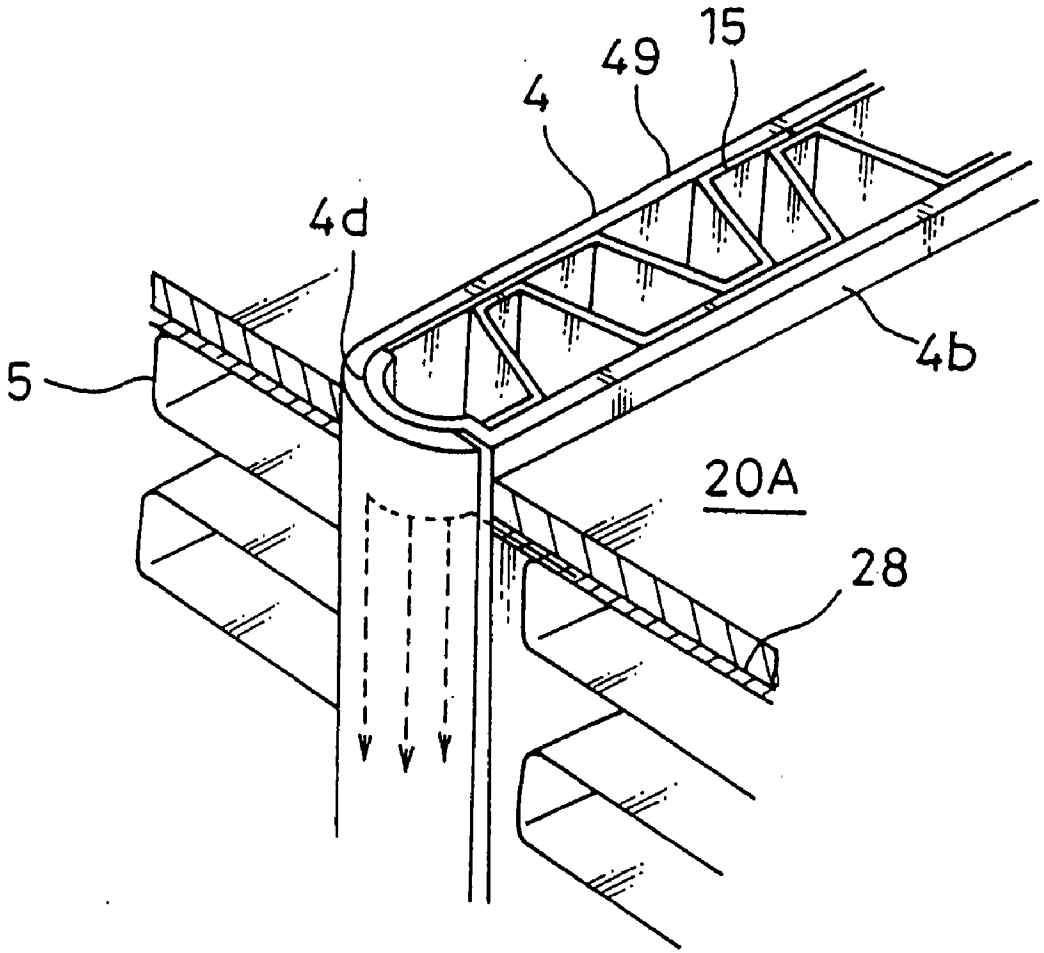
FIG. 7 illustrates how a brazing material is supplied to the bonding regions of oblate tubes from the tank side through capillary action.

A brazing material sheet 29 having holes 29A each corresponding to a tube insertion hole 19 is attached onto the tube insertion hole formation surface 20A of each of the tanks 2 and 3, as shown in FIG. 5, or a brazing material is sprayed with nozzles 31 onto the tube insertion hole formation surface 20A of each tank as shown in FIG. 6, so as to supply a brazing material 28 onto the front surface of the tube insertion hole formation surface 20A, as shown in FIG. 7. It is to be noted that the brazing material sheet 29 is pasted onto the tube insertion hole formation surface 20A by adopting the following structure in the embodiment.

Namely, during the extrusion molding process, the tube insertion hole formation surface 20A is formed so as to achieve the greatest height at the center along the direction of the airflow and to form a staged portion 30 extending along the lengthwise direction near each of the two edges of the tube insertion hole formation surface 20A on both sides along the lengthwise direction. The staged portion 30, against which an end of the brazing material sheet 29 is abutted, is formed so as to project out over a predetermined width beyond the tube insertion hole formation surface 20A with its inner surface ranging substantially perpendicular to the tube insertion hole formation surface 20A to ensure that the end of the brazing material sheet 29 is not allowed to slide over the staged portion. The brazing material sheet 29 is obtained by cutting a sheet of brazing material from a coil of rolled aluminum silicon alloy (e.g., A4000). The brazing material sheet is elasticized in advance by flexing the shorter sides thereof in a circular arc. Thus, as the brazing material sheet 29 is set in contact with the tube insertion hole formation surface 20A and the flexure is released, a spring-back is induced at the brazing material sheet 29, causing the brazing material sheet to expand on its shorter sides until the ends on the shorter sides of the brazing material sheet become abutted against the staged portions 30, and thus, the brazing material sheet 29 becomes attached to the tube insertion hole formation surface 20A at each of the tanks 2 and 3. In addition, claw tabs 32 are disposed at the caps 21 in the example so that the brazing material sheets 29 can be attached onto the tube insertion hole formation surfaces 20A even more firmly by holding the edges of the brazing material sheets 29 along their shorter sides with the claw tabs 32 when the caps 21 are mounted at the openings of the tanks 2 and 3.

When the heat exchanger 1, having been temporarily pre-assembled, undergoes the process of furnace brazing, the tanks 2 and 3 and the heat exchange tubes 4 are brazed together via the brazing material 28 supplied to the tube insertion hole formation surfaces 20A at the tanks 2 and 3. Also, as indicated by the dotted lines in FIG. 7, the brazing material 28 is supplied to the bonding regions 4*d* at the heat exchange tubes 4 through capillary action to penetrate the spaces between the joining surfaces of the bonding regions 4*d* along the longer sides of the heat exchange tubes 4, thereby brazing the bonding regions 4*d*, as well. Thus, even though the heat exchange tubes 4 are formed through roll forming, it is not necessary to cover the surface of the sheet material with a brazing material layer, which allows the wall thickness of the heat exchange tubes 4 to be reduced and enables economical utilization of the brazing material.

Furthermore, the inner fins 15 are housed inside the heat exchange tubes 4, and when stacking the heat exchange tubes 4 and the outer fins 5 alternately, the contact surface edges of the bonding regions 4*d*, the outer fins 5 and the inner fins 15 are not allowed to come into contact with one another, as shown in FIGS. 4(*a*) and 7. Thus, the brazing material 28 having been supplied into the space between the contact surfaces at the bonding regions 4*d* through capillary action is not drawn toward the outer fins 5 or the inner fins 15.

INDUSTRIAL APPLICABILITY

As explained above, according to the present invention, the heat exchange tubes are not coated with a brazing material layer and problems such as the dispersion of the brazing material during the brazing process and erosion become non-issues. As a result, the wall thickness of the heat exchange tubes can be reduced, and the heat exchanger achieved by using such heat exchange tubes can be provided as a compact and lightweight unit at lower cost.

In particular, according to the present invention, when the heat exchanger undergoes the process of furnace brazing, the brazing material having been supplied into the spaces between the contact surfaces on the bonding margin side of the heat exchange tubes from the tank surfaces through capillary action, is not allowed to be drawn toward the outer fins via the contact areas with the outer fins, and thus, defective brazing does not occur at the bonding regions of the heat exchange tubes.

Also, according to the present invention the side portion and the partitioning portion of each tank are formed as an integrated unit through extrusion molding of the tank in order to eliminate the risk of the heat exchanging medium bypassing the chambers in the tank due to defective brazing of the partitioning wall and, at the same time, the brazing material can be supplied with a high level of reliability from the tank side to the bonding regions of the heat exchange tubes.

The invention claimed is:

1. A method for manufacturing a heat exchanger, said method comprising:

forming heat exchange tubes of sheet material not having brazing material thereon, the heat exchange tubes having longitudinal bonding regions whereat edges of the sheet material overlap;

assembling a heat exchanger by connecting a first tank having a first brazing layer disposed on a surface thereof with a second tank having a second brazing layer disposed on a surface thereof via a plurality of the heat exchange tubes such that the first tank communicates with the second tank via the heat exchange tubes, each of the plurality of heat exchange tubes having a first end portion fixed to the first tank on the surface having the first brazing layer and a second end portion fixed to the second tank on the surface having the second brazing layer;

brazing the heat exchanger so as to cause capillary action to draw brazing material from the first brazing layer and the second brazing layer into the longitudinal bonding regions;

disposing a plurality of outer fins in an alternating pattern with the plurality of heat exchange tubes so that no edges of the longitudinal bonding regions contact the plurality of outer fins.

2. The method for manufacturing a heat exchanger according to claim 1, further comprising:

forming the first tank and the second tank by extrusion molding;

disposing the first brazing layer on the surface of the first tank by attaching a brazing sheet thereto; and disposing the second brazing layer on the surface of the second tank by attaching a brazing sheet thereto.

3. The method for manufacturing a heat exchanger according to claim 1, further comprising:

forming the first tank and the second tank by extrusion molding;

disposing the first brazing layer on the surface of the first tank by spraying brazing material thereon; and disposing the second brazing layer on the surface of the second tank by spraying brazing material thereon.

4. A method for manufacturing a heat exchanger, said method comprising:

forming heat exchange tubes of sheet material not having brazing material thereon, the heat exchange tubes having longitudinal bonding regions whereat edges of the sheet material overlap;

forming a first tank and a second tank by extrusion molding;

assembling a heat exchanger by connecting the first tank with the second tank via a plurality of the heat exchange tubes such that the first tank communicates with the second tank via the heat exchange tubes;

disposing brazing material as a first brazing layer on the first tank by attaching a brazing sheet thereto;

disposing brazing material as a second brazing layer on the second tank by attaching a brazing sheet thereto;

brazing the heat exchanger so as to braze the bonding regions with brazing material from the first brazing layer and the second brazing layer; and disposing a plurality of outer fins in an alternating pattern with the plurality of heat exchange tubes so that no edges of the longitudinal bonding regions contact the plurality of outer fins.

5. A method for manufacturing a heat exchanger, said method comprising:

forming heat exchange tubes of sheet material not having brazing material thereon, the heat exchange tubes having longitudinal bonding regions whereat edges of the sheet material overlap;

forming a first tank and a second tank by extrusion molding;

assembling a heat exchanger by connecting the first tank with the second tank via a plurality of the heat exchange tubes such that the first tank communicates with the second tank via the heat exchange tubes;

disposing brazing material as a first brazing layer on the first tank by spraying brazing material thereon;

disposing brazing material as a second brazing layer on the second tank by spraying brazing material thereon;

brazing the heat exchanger so as to braze the bonding regions with brazing material from the first brazing layer and the second brazing layer; and disposing a plurality of outer fins in an alternating pattern with the plurality of heat exchange tubes so that no edges of the longitudinal bonding regions contact the plurality of outer fins.

* * * * *